United States Patent [19]

Meshberg

[11] Patent Number: 4,457,454

[45] Date of Patent: Jul. 3, 1984

[54] TWO-COMPARTMENT DISPENSER

[76] Inventor: Philip Meshberg, 2500 S. Ocean Blvd., Palm Beach, Fla. 33480

[21] Appl. No.: 315,243

[22] Filed: Oct. 26, 1981

[51] Int. Cl.[3] ..... B65D 37/00

[52] U.S. Cl. ..... 222/95; 222/209; 222/212; 222/321; 222/386.5; 222/383

[58] Field of Search ..... 222/207, 209, 212-213, 222/215, 321, 341, 95, 380, 383, 386.5, 387, 402.2, 402.11

[56] References Cited

U.S. PATENT DOCUMENTS

| | | | |
|---|---|---|---|
| 2,081,253 | 5/1937 | Serre | 222/207 |
| 2,536,277 | 1/1951 | Grieme | 222/380 X |
| 2,808,966 | 10/1957 | Hall et al. | 222/207 |
| 2,855,127 | 10/1958 | Lerner et al. | 222/215 X |
| 3,010,613 | 11/1961 | Stossel | 222/207 X |
| 3,088,636 | 5/1963 | Spatz | 222/213 |
| 3,124,275 | 3/1964 | Lake | 222/321 X |
| 3,146,920 | 9/1964 | Benjamin | 222/321 |
| 3,223,289 | 12/1965 | Bouet | 222/209 |
| 3,268,123 | 8/1966 | Spatz | 222/400.5 |
| 3,420,413 | 1/1969 | Corsette | 222/107 |
| 3,870,200 | 3/1975 | Spatz | 222/206 |
| 4,008,830 | 2/1977 | Meshberg | 222/95 |
| 4,154,371 | 5/1979 | Kolarzinski et al. | 222/212 |

FOREIGN PATENT DOCUMENTS

| | | | |
|---|---|---|---|
| 1064626 | 5/1954 | France | 222/321 |
| 2395732 | 3/1979 | France | 222/341 |

*Primary Examiner*—Charles A. Marmor
*Attorney, Agent, or Firm*—Kenyon & Kenyon

[57] ABSTRACT

A two-compartment dispenser of fluent material includes a primary compartment having a collapsible wall and initially holding the main body of the material, a secondary compartment, and a compartment separator that forms a barrier between the two compartments and has a passage for the fluent material to flow from the primary to the secondary compartment. A dispensing nozzle as connected to the secondary compartment, which also has a movable wall portion resiliently biased to expand the volume of the secondary compartment to its fullest extent. A check valve controls the passage through the compartment separator and is closed when the movable part of the secondary compartment is pressed inwardly to force fluent material from the secondary compartment out through the dispensing nozzle. Release of pressure on the movable part reduces pressure in the secondary compartment and allows the check valve to open so that fluent material can flow from the primary compartment to the secondary compartment. Ambient air pressure on the collapsible wall reduces the volume of the primary compartment an amount equal to the volume of material transferred to the secondary compartment. A rigid outer casing vented to the atmosphere protects the collapsible primary compartment from being inadvertently squeezed.

4 Claims, 9 Drawing Figures

TWO-COMPARTMENT DISPENSER

BACKGROUND OF THE INVENTION

1. Field of the Invention

This invention relates to the field of dispensers of fluent material. In particular, it relates to a two-compartment dispenser in which fluent material in a collapsible primary compartment is transferred through a valve-controlled passage to a secondary compartment and from the latter out of the dispenser by way of a discharge nozzle in response to alternate depression and release of a resiliently biased part of the wall of the secondary compartment.

2. The Prior Art

My U.S. Pat. No. 4,008,830 describes a dispenser of liquid or viscous materials from a collapsible bag by means of a non-vented pump. The mouth of the bag is joined liquid-tight to the pump. As the pump is actuated to expel the material within it and is then released, atmospheric pressure collapses the bag and forces another quantity of the material into the pump.

While that dispenser works quite well, it requires a pump which is somewhat complex.

Another dispenser that includes a pump and operates on the same principle is disclosed in U.S. Pat. No. 3,420,413 of Corsette.

Spatz discloses, in U.S. Pat. No. 3,088,636, a dispenser that has a deformable, spring-biased cover at one end of a rigid cylindrical body. Pressure on the cover to reduce the space in it forces open a spring-biased mouth through which fluent material is then discharged. Releasing the pressure allows the mouth to reclose and the cover to return to its original volume, which reduces pressure in the dispenser. As a result, atmospheric pressure pushes a piston at the other end of the cylinder inward to occupy a volume equal to that of the material just discharged. The piston has resilient fingers that engage the part of the cylinder wall just vacated by the piston, thus preventing the piston from moving in the opposite direction. However, leakage at that end of the cylinder is prevented only by the accuracy of fit between the piston and cylinder. Other Spatz patents that show similar one-way pistons are U.S. Pat. Nos. 3,268,123 and 3,870,200.

U.S Pat. No. 4,154,371 to Kolacziuski et al shows a similar dispenser with the same type of piston at one end of a cylinder and, at the other end, a compressible, generally dome-shaped cover that includes an integral actuator terminating in a discharge nozzle.

All of the foregoing, one-way piston dispensers have only a single compartment in which the fluent material is contained. As a result, pressure on the compressible or movable member at the other end requires that the piston hold firmly in position against any force that would tend to push it backward. The resilient fingers must dig into the cylinder wall enough to prevent any such backward movement, which means that only certain materials can be used for the cylinder.

U.S. Pat. No. 3,223,289 to Bouet discloses various embodiments of dispensers having a collapsible inner compartment within an outer container. In several embodiments, the side walls of the outer container are slightly deformable, and, when they are compressed, they cause pressure to be transmitted to the collapsible compartment by air in the space between the collapsible compartment and the outer container. A check valve in the wall of the outer container allows additional air to enter the space when pressure on the outer container wall is released. In one embodiment, the wall of the container surrounding the collapsible compartment is rigid, and a separate compartment is provided that has an elastomeric wall that can be squeezed to reduce its volume. The squeezable compartment has two check valves, one of which controls a passage to the space surrounding the collapsible compartment in the rigid-walled container and the other of which controls a passage between the squeezable compartment and the surrounding air. The collapsible compartment has a nozzle that is always open and through which fluent material can either be drawn into or discharged from it, either each time the squeezable compartment is squeezed or each time it is released, depending on the way the check valves are arranged.

OBJECTS AND SUMMARY OF THE INVENTION

It is one object of this invention to provide a simplified two-compartment dispenser in which fluent material is initially protectively held in a collapsible compartment and a wall of the other compartment is manipulated to transfer the material to that compartment and then to discharge it.

Further objects will be apparent from the following specification together with the drawings.

In accordance with this invention, one compartment of a two-compartment dispenser has a collapsible wall joined fluid-tight to a second compartment by a compartment separator that defines at lease part of a wall common to both compartments.

A passage through the compartment separator is controlled by a valve responsive to movement of a resiliently biased, movable part of the wall of the second compartment. When pressure is exerted on that part of the wall to reduce the volume in the second compartment, the valve closes the passage and fluent material in the second compartment can only be expelled through a discharge nozzle. When such pressure is released, the valve opens the passage between compartments at the same time that return of the movable part of the wall to its original position reduces pressure in the second compartment, allowing atmospheric pressure on the collapsible compartment to force enough fluent material through the passage to replace the material expelled through the discharge nozzle.

The valve can be a ball or flap type of check valve or it can be a piston attached to the movable part of the wall and aligned with the passage to plug up the passage when the movable part of the wall is pressed inwardly. The piston can include an internal passage with an entrance to the second compartment and an exit to which a discharge nozzle is connected and through which fluent material squeezed out of the second compartment is discharged from the dispenser. The entrance should be spaced well away from the end of the piston that enters the passage through the compartment separator.

A closure may be attached to the outer end of the nozzle to be opened only when it is desired to discharge material from the nozzle and to be closed at all other times to prevent air from reaching the fluent material just inside the nozzle.

DETAILED DESCRIPTION OF THE INVENTION

Figure 1:
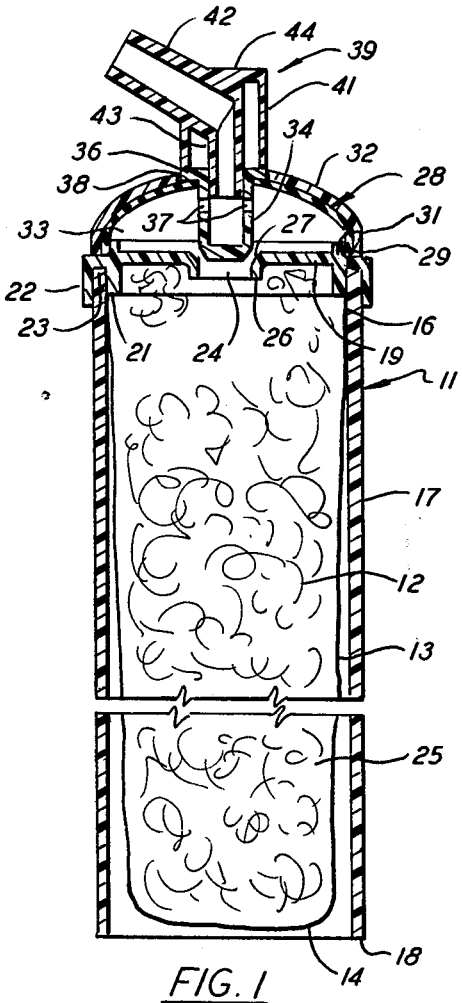
FIG. 1 is a cross-sectional view of one embodiment of a dispenser according to the present invention.

The dispenser 11 in FIG. 1 is suitable for dispensing various types of fluent material 12, especially products that are rather viscous, such as creamed food stuff, toothpaste, and the like, and it is also suitable for the dispensing of liquid products. The fluent material is carried in a container 13, which may be arranged in the manner described in my U.S. Pat. No. 4,008,830 or my co-pending U.S. application Ser. No. 310,987 filed Oct. 13, 1981 entitled Collapsible Container. The collapsible container 13 is shown in this embodiment as being generally tubular in shape and closed at one end 14. It is open at the other end 16 where it is joined to a rigid outer case 17 that protects the container 13 from being squeezed inadvertently or even ruptured. The outer case also furnishes support for the collapsible container during filing operations. In this embodiment the outer case is in the form of a hollow cylindrical tube originally open at both ends until the container 13 is inserted and longer than the container 13 and made of plastic, metal, cardboard, glass, or other material.

The fact that the outer case 17 is a tube open at the end 18 allows the atmosphere to reach the outer surface of the collapsible container 13 without hindrance so as to collapse the container 13 as the fluent material 12 is withdrawn from it. It is not necessary that the entire end 18 be open provided there is some aperture through which the interior of the case 17 is vented to allow the atmosphere to reach and compress the collapsible container as the fluent material is withdrawn from it.

A rigid disk 19 is attached to the open end 16 of the collapsible container 13. One way of doing so is to provide concentric inner and outer cylindrical flanges 21 and 22 defining an annular groove 23 between them wide enough to allow the end 20 of the outer case 17 with the edge of the collapsible container 13 folded over it to be forced into the groove. Although the disk 19 is relatively rigid, it must be smooth enough to accept the relatively soft collapsible container material without tearing it. The container 13 may be molded of thin, flexible liquid-tight material or it may be formed by extrusion or blow molding of one end of the outer case 17, provided the latter is made of a suitable plastic material. It can also be assembled by sealing the edges of two pieces of flexible plastic material together. In any case, it is important that the disk 19 be firmly attached to the outer case 17 and that there be a fluid-tight joint between the rigid disk 19 and the end 16 of the collapsible container 13 so that the disk closes a primary compartment 25 within the container.

The disk 19 has a central passage 24, part of which is defined by an annular ridge 26 that is integrally formed with the disk 19. The other part of the passage 24 is a frusto-conical portion 27 that faces in the opposite direction from the collapsible container 13.

A movable cover, which in the present embodiment is an elastomeric dome 28, has a perimeter 29 sealed fluid-tight to the rigid disk 19. This is accomplished by squeezing the perimeter 29 between a cylindrical shoulder 31 on the upper surface of the rigid cover 19 and the lowermost part of an outer rigid dome 32. The rigid dome is shaped to conform to the outer surface of the elastomeric dome 28, and the latter is formed so that, in the absence of any pressure on either side of it, it has the shape shown in the drawing. The elastomeric nature of the dome 28 serves to keep all parts of it spaced away from the rigid disk 19. The space between the flexible done 28 and the disk 19 constitutes a secondary compartment 33 into which the fluent material 12 can enter by way of the passage 24 as long as that passage is open, which is the condition in which it is shown in FIG. 1.

The dispenser 11 also includes valve means in the form of a piston 34 shaped to fit the passage 24. The piston 34 is closed at the end facing the rigid disk 19, but the closed end is normally held spaced from the rigid disk by the natural configuration of the elastomeric dome 28, as shown in FIG. 1. The piston 34 is molded of a suitable plastic material that can slide easily in the passage 24 but fits the inner cylindrical wall of the passage tightly enough to prevent the fluent material 12 from getting past the piston when the latter has been pushed down into the passage 24. A flange 36 at one end of the piston 34 extends over the surrounding region of the dome 28 and furnishes additional surface area to which the dome can be sealed in forming a liquid-tight seal between the dome and the piston. The interior of the piston 34 is hollow to form a discharge channel for the fluent material that enters the piston from the secondary compartment 33 by way of apertures 37 in the cylindrical wall of the piston just below the intersection between the piston 34 and the dome 38.

The flange 36 is normally held within an aperture 38 in the rigid dome 32 when the elastomeric dome 28 is in the normal configuration in which it conforms to the inner surface of the rigid dome. A molded plastic actuator 39 engages the piston 34 and has an outer skirt 41 that rests on the flange 36. The actuator comprises nozzle means 42 communicating with the secondary compartment 33 by way of an inner tubular member 43 that extends into the upper end of the hollow piston 34. The actuator 39 has a pressure surface 44 to which finger pressure is applied to depress the movable cover, which, in this embodiment, is the dome 28, inwardly toward the disk 19.

Figure 2:
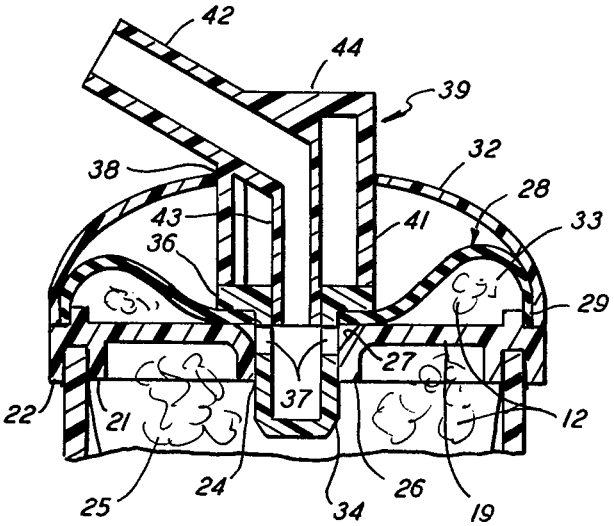
FIG. 2 is an enlarged cross-sectional view of a fragment of the dispenser in FIG. 1 in a dispensing position.

FIG. 2 shows the dome 28 fully depressed so that its central region is pressed against the disk 19 by pressure on the actuator 39. This position of the dome 28 reduces the volume of the secondary compartment 33 as much as is possible in this embodiment and forces part of the fluent material 12 in that compartment to flow through the apertures 37, and the inner tubular member 43. This part of the fluent material is dispensed through the nozzle 42.

As will be noted in FIG. 1., when the piston 34 is pressed downwardly, it enters the passage 24 and, as shown in FIG. 2., completely stops up that passage. It is the closing of the passage 24 that forces material 12 in the secondary compartment 33 to be discharged through the nozzle 42 rather than being pressed back into the primary compartment 25.

The frusto-conical portion 27 of the inner surface of the passage 24 not only helps guide the lower, tapered end of the piston 34 into the more constricted part of the passage but it also enlarges the entrance to the apertures 37 when the elastomeric dome 28 is in the final stage of its descent toward the disk 19. The reason for locating the apertures 37 as close as possible to the lower surface of the dome 28 is to leave an entryway from the secondary compartment 33 to the interior of the piston 34 until the central region of the dome is almost in contact with the disk 19.

During the movement of the actuator 39 downwardly, it is partly guided by the rim of the aperture 38 in the rigid dome 32 and partly by the passage 24. The upward movement of the actuator, following release of pressure on the surface 44, is due to the resilient bias provided by the elastomeric nature of the material of which the dome 28 is made. This re-expands the secondary compartment and in so doing reduces the pressure within it. As the piston 34 is withdrawn from the passage 24, the reduction in internal pressure is communicated to the primary compartment 25. Atmospheric pressure on the outer surface of the collapsible container 13 compresses the latter just enough to equalize pressure on both sides of the container wall and, in so doing, reduces the volume within the collapsible container by the same amount as the volume of fluent material that was dispensed during the downward stroke of the actuator 39.

The nozzle 42 may be capped between usages, if desired, but some types of fluent material do not need to be capped. While it might be expected that the reduction in pressure within the secondary compartment 33 upon release of the actuator 39 would draw air in through the nozzle 42 rather than new fluent material 12 from the collapsible container 13, the passage 24 is less constricted than the path through the nozzle 42, the inner tubular member 43, and the apertures 37, so that the reduced pressure in the secondary compartment draws only some of the fluent material back out of the piston 34 and, perhaps, the inner tubular member 43 toward the secondary compartment. The undischarged material left in the nozzle 42 may be drawn partly back toward the secondary compartment 33, awaiting the next dispensing stroke on the actuator 39, but it will not return all the way to the secondary compartment.

The original filling of the dispenser 11 consists of several steps. Typically, before the collapsible container 13 is covered by the disk 19, it is assembled with the rigid outer case 17, and the proper quantity of fluent material 12 is directed into it. Then, the disk 19 is snapped into position gripping the upper rim of the outer case 17 and holding the upper open end 16 of the collapsible container 13 tightly enough in the groove 23 to form a fluid-tight joint between the disk 19 and the open end 16. The elastomeric dome 28, to which the piston 34 has been attached, and the rigid dome 32 are forced onto the shoulder 31.

Air trapped in the secondary compartments 33 is then withdrawn and fluent material 12 from the primary compartment 25 is allowed to move into the secondary compartment. If the actuator 39 was not assembled with the piston 34 previously, it is so assembled at this point.

Figure 3:
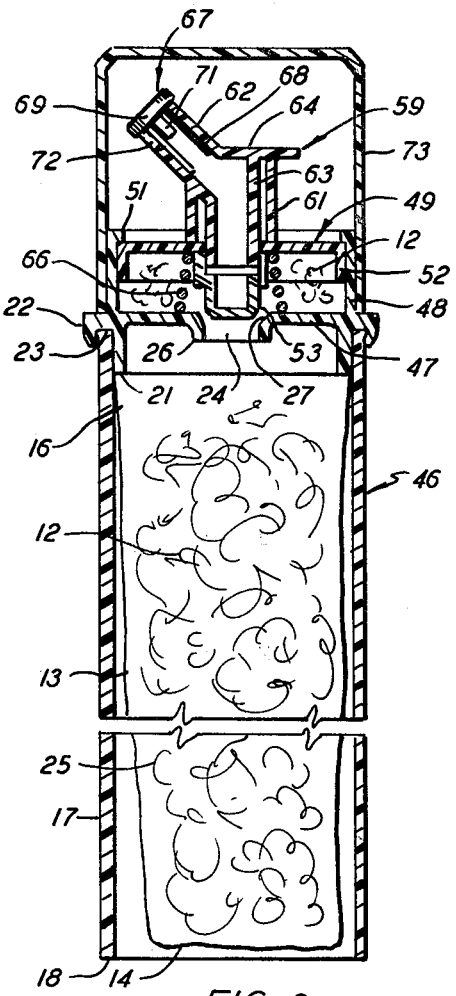
FIG. 3 is a cross-sectional view of a modified embodiment of a dispenser according to this invention.

Another embodiment 46 of a dispenser is shown in FIG. 3. The collapsible container and the rigid outer case 17 are the same as in the dispenser 11 in FIGS. 1 and 2. A rigid disk 47 that forms a compartment separator is somewhat similar to the compartment separator disk 19 in FIGS. 1 and 2 but differs from the compartment separator 19 in important features. The lower surface of the compartment separator 47 has the same concentric, axially extending flanges 21 and 22 as does the compartment separator 19 and these flanges define the same groove 23 between them. The passage 24 defined by the annular ridge 26 and having a frusto-conical inner surface portion 27 is also the same.

An open cylinder 48 extends upwardly from the compartment separator 47 and is closed by a movable cover in the form of a piston 49 free to slide therein. A slight inwardly directed flange 51 holds the piston properly assembled within the cylinder 48, and a skirt 52 on the piston keeps the axis of the piston 49 from rocking. The piston 49 is preferably molded of a suitable plastic to form a reasonably tight but sliding fit with the cylinder 48, and a second piston 53 is integrally molded on the underside of the piston 49 and aligned to fit tightly but movably in the passage 24.

Figure 4:
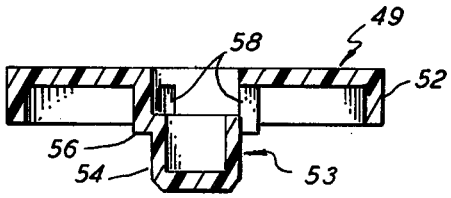
FIG. 4 is a cross-sectional view of one of the components in the dispenser in FIG. 3.
Figure 5:
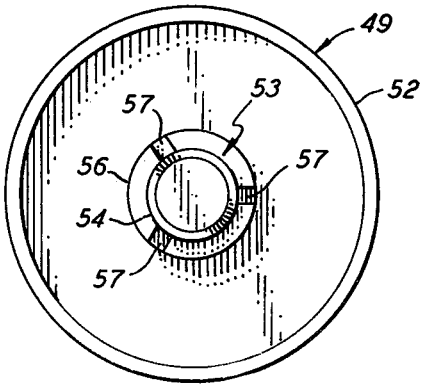
FIG. 5 is a view of the underside of the component in FIG. 4.

The unitary plastic member that comprises the pistons 49 and 53 is shown separately in FIGS. 4 and 5 to be more clearly visible. As is shown there, the piston 53 includes a lower portion 54 that has an outer diameter of the proper size to fill the passage 24 in FIG. 3. Above the portion 54 is a step portion 56 that has an inner diameter of the same size as the outer diameter of the lower portion 54. The step portion is molded with gaps 57 that result in apertures 58 through the cylindrical wall of the step portion immediately below the piston 49.

An actuator 59 comprising an outer skirt 61, a nozzle 62, and an inner tubular member 63 is attached to the piston 49. The inner tubular member 63 extends down into the step portion 56 and may be held in place by suitable interlocking recesses and projections. The actuator has a pressure surface 64 to receive finger pressure to force the piston 49 toward the compartment separator 47. A conically helical spring 66 is guided on the piston 53 and compressed between the piston 49 and the compartment separator 47 to provide resilient bias urging the piston 49 away from the compartment separator 47. The compartment separator, the cylinder 48 and the piston 49 constitute walls of a secondary compartment 66.

In operation, the volume of the secondary compartment is reduced by pressure on the surface 64 of the actuator to close the passage 24 by means of the lower portion 54 of the piston 53 and thereby leave no alternative but for some of the fluent material 12 in the secondary compartment to flow out through the nozzle 62. Dispensing the fluent material 12 requires alternatively pressing the piston 49 toward the compartment separator 47 and releasing it, thereby alternatively increasing and reducing pressure in the secondary compartment 66 while simultaneously alternating between closing and opening the passage 24. In such operation, the piston 49 is being used as a movable cover over the major part of the compartment separator 47. As pressure is reduced in the secondary compartment 66 and as the piston 53 is removed from the passage 24 where it acts like a check valve, atmospheric pressure on the container 13 collapses it by a small amount equal to the amount of fluent material dispensed during the pressure stroke.

The nozzle 62 has a cap 67 at its end. This cap includes a hollow cylinder 68 closed at one end by a knurled disk 69. One or more slots 71 in the cylinder 68 can be aligned with a slot 72 in the nozzle 62 to allow egress of the fluent material 12. The cap can then be twisted to misalign the slots 71 and 72, thereby closing off the nozzle 62. This is desirable for many fluent materials, especially those of a less viscous nature.

A cover 73 is press-fitted on the outer surface of the cylinder 48 for protection of the actuator 59.

Figure 6:
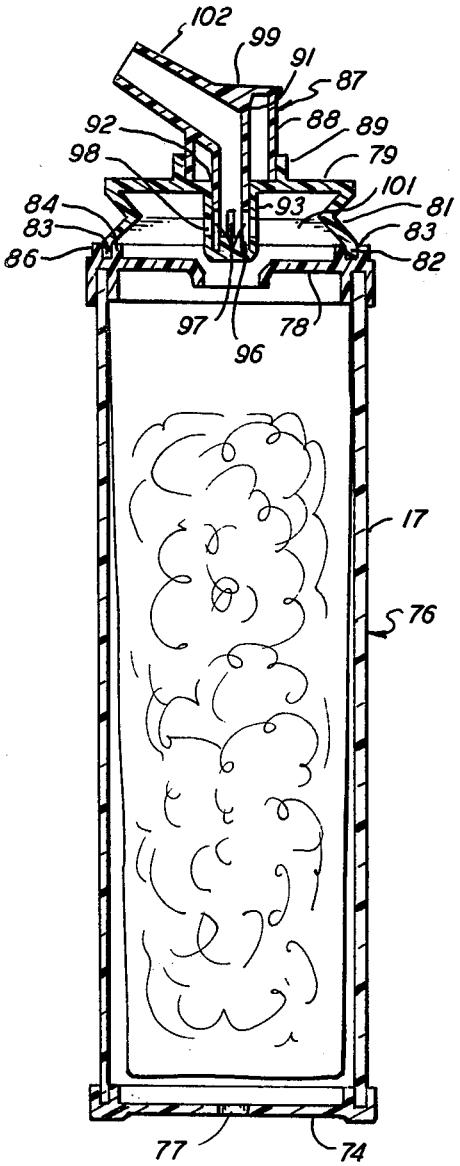
FIG. 6 is a cross-sectional view of still another embodiment of a dispenser according to the present invention.

In the embodiment in FIG. 6, a disk 74 is attached to the lower end of the rigid outer case 17 of a dispenser 76. However, it is necessary for the outer case to be vented to allow atmospheric pressure to be applied to the outer surface of the collapsible container 13, and the vent is an aperture 77 in the disk 74. Except for the disk, the lower part of the dispenser 76 is like the lower part of the dispenser 11 in FIG. 1.

A compartment separator 78 in the form of a rigid desk is pressed onto the upper end of the outer case 17 in a manner similar to the compartment separator disk 19 in FIG. 1. A cover 79 comprises a movable part in the form of a rigid plastic disk with an integrally molded accordion-pleated skirt 81 attached fluid-tight to the upper surface of the compartment separator 78 by pressing a lower edge portion 82 of the skirt 81 in a groove 83 between two concentric axial flanges 84 and 86.

Figure 7:
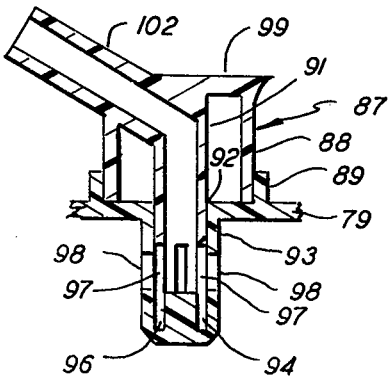
FIG. 7 is a cross-sectional view of a fragment of the dispenser in FIG. 6 in a dispensing position.

The embodiment in FIG. 6 has an actuator 87 shown enlarged somewhat in FIG. 7. The actuator has an outer skirt 88 held on the cover 79 by an annular ridge 89 in such a way that the actuator can rotate but preferably only over a limited angle. The reason for such rotation is that the actuator 87 comprises a central inner tubular member 91 that extends into a cylindrical recess 92 inside a piston 93 closed at its lower end. The inner surface of the piston 93 has a annular axial groove 94 to receive the lower end 96 of the tubular member 91. There are longitudinal slots 97 in the end 96, and the actuator 87 can be rotated to align those slots with apertures 98 in the cylindrical wall of the piston 93.

When the dispenser 76 in FIG. 6 is to be operated, the actuator 87 is rotated on its axis to align the slots 97 with the apertures 98 and then pressure is applied to a pressure surface 99 to force the movable cover 79 toward the compartment separator 78. The piston 93, serving as a check valve, enters and thereby closes the passage 24, while the volume of the secondary compartment 101 diminishes and forces fluent material out through a nozzle 102. When pressure on the surface 99 is released, the natural resilience of the accordion-pleated skirt causes the movable cover 79 to return to the position shown, thereby expanding the secondary compartment 101 and drawing a replacement quantity of fluent material into it from the primary compartment 25. The actuator 87 can be left in the open position during expansion of the secondary compartment 101 to allow some of the fluent material in the nozzle 102 and the inner tubular member 91 to be drawn back through the apertures 98 into the secondary compartment 101, thereby keeping it from being affected by the atmosphere. After the material has been drawn back, the actuator can be pivoted to the closed position shown in FIG. 6 in which the slots 97 are not aligned with each other.

Figure 8:
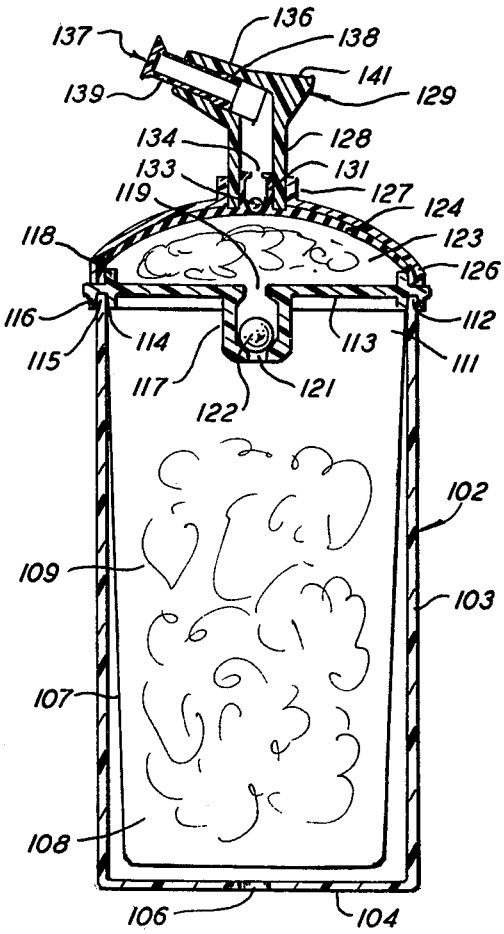
FIG. 8 is a cross-sectional view of yet another dispenser according to this invention.

FIG. 8 shows an embodiment of a dispenser 102. Unlike the other embodiments, in which the main part of the rigid outer case was a tube and could have been formed as such of any suitable material, such as plastic, metal, glass, or even cardboard, the dispenser 102 has a rigid outer case 103 with an integral bottom wall 104 through which there is an aperture 106 to admit air. The case 103 is preferably molded of plastic, although other materials that could be molded or drawn would be satisfactory. It encloses a collapsible container 107, that defines a primary compartment 108 in which there is, initially, a supply of fluent material 109, generally, but not necessarily, of a rather viscous nature, such as salad dressing, liquid soap, toothpaste or any of a large number of other materials that can be satisfactorily dispensed by means of such a device.

The initial contours of the container 107, at least after the container has been filled with the fluent material 109, correspond generally to the outer case 103. The collapsible container 107 is open at one end 111, and the edge of the collapsible container is stretched over the open lip 112 of the case 103 and securely held in place by a compartment separator 113 in the form of a plastic disk molded with two concentric, axial flanges 114 and 116 and a check valve ball cage 117 on one surface and an axial ridge 118 on the opposite surface and concentric with the ridges 114 and 116. Between the ridges 114 and 116 is a groove 115 into which the lip 112 covered by the edge of the collapsible container 107 can be forced. This forms a liquid-tight joint between the collapsible container and the compartment separator 113.

The cage 117 is generally cylindrical and is directly below a central aperture 119 through the compartment separator 113. At the lower end of the cage is an aperture 121 and within the cage is a smooth-surfaced ball 122 a little smaller than the inner diameter of the cage and too large to fit through either of the apertures 119 and 121 except when forced through the aperture 119 during assembly of the components. The surface interior to the cage 117 and immediately surrounding the aperture 121 is a smooth seat against which the ball 122 can fit snugly.

A secondary compartment 123 is located above the upper surface of the compartment separator 113 and below an elastomeric dome 124. The dome 124 is enclosed within a rigid dome 126, the perimeter of which squeezes the perimeter of the dome 124 against the outer shoulder of the axial ridge 118 to form an airtight seal between the compartment separator 113 and the elastomeric dome 124. The rigid dome 126 has a central opening with a short tubular guide 127 extending from the perimeter of the central opening and pointing away from the secondary compartment 123. Within the guide 127 is a tube 128 of an actuator 129, and within the tube 128 is a cylindrical check valve cage 131 that is formed integrally with the elastomeric dome 124 and is secured to the actuator tube 128. At the lower end of the cage is an opening 132 through the center of the dome 124. A ball 133 larger in diameter than the opening 132 is held within the cage 131 by a constriction 134 at the upper end of the cage.

The actuator 129 has a nozzle 136 within which there is a tubular sliding cap 137 with an outwardly extending ridge 138 captured within the nozzle 136. The cap 137 has an opening 139 near its outer, closed end, and the longitudinal range of travel of the cap allows the opening 139 to be outside of the nozzle 136 in the dispensing position or retracted inside the nozzle in the closure condition.

At the top of the actuator 129 is a finger rest 141 that serves as a pressure surface against which finger pressure can be applied to force the actuator and, thereby, the central part of the elastomeric dome toward the interior of the secondary compartment 123 of the dispenser 102. When the actuator is depressed, hydraulic pressure of the fluent material 109 in the secondary compartment 123 forces the ball 122 of the first check valve tightly against its seat at the aperture 121, thus closing that aperture and preventing any of the fluent material 109 in the secondary compartment 123 from passing through that aperture to the primary compartment 108.

At the same time, the ball 133 is pushed up against the constriction 134 but does not fit in such a way as to close off that constriction. The fluent material 109 in the secondary compartment 123 can therefore flow out through the tube 128. If the cap 137 has not been pulled out to the dispensing position shown, the pressure of the fluent material against its inner surface will force the cap to the dispensing position.

When pressure on the surface 141 is released, the elastomeric dome 124 returns automatically to the expanded shape shown, thus reducing pressure within the secondary compartment 123. Both balls 122 and 133 will be drawn toward the interior of the secondary compartment by the reduced pressure therein. When the ball 133 is thus drawn into its seat, it closes off the aperture 121 and prevents any air from being drawn down through the actuator 129 into the second compartment 123. At the same time, the ball 122 is drawn up against the constriction that defines the aperture 119 and, like the constriction 134, does not fit around the ball so as to prevent fluent material 109 from the primary compartment 108 from flowing past it into the secondary compartment 123. This prevents the fluent material 109 in the secondary compartment 123 from being contaminated or affected by air or by any of the product that has moved past the ball 133. The material that remains in the actuator can also be protected by closing the cap 137. As in the other embodiments, external air pressure on the collapsible container 107 causes it to collapse to reduce the volume of the primary compartment 108 by the same amount as the volume of fluent material 109 dispensed through the nozzle 136.

Figure 9:
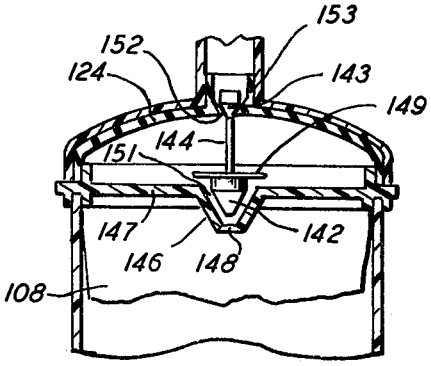
FIG. 9 is a cross-sectional view of a fragment of a modified valve for use in the dispenser in FIG. 8.

FIG. 9 shows a modification in which the closure members of the two check valves are directly connected together to close alternatively. In this embodiment, only the configuration of the components related to the check valves differs from the embodiment in FIG. 8. Instead of two balls as the closure members, the embodiment in FIG. 9 has two tapered plugs 142 and 143 pointing toward the primary compartment 108. These plugs are preferably molded of a suitable plastic as a unitary structure that includes a rod 144. The tapered plug 142 is shaped to fit snugly in a frusto-conical shell 146 that extends downwardly from a compartment separator disc 147. The frusto-conical shell is an integrally molded part of the compartment separator and has an opening 148 at its constricted lower end facing the primary compartment 108. A radial flange 149 extends from the upper end of the plug 142 and helps seal the passage 151 through the compartment separator 147 when the elastomeric dome 124 is pushed inwardly to dispense a quantity of fluent material 109 from the secondary compartment 123.

The plug 143 is somewhat smaller than the plug 142 and fits snugly into a conical seat 152 in the center of the elastomeric dome 124. A short tubular portion 153 of the elastomeric dome extends upwardly around the conical seat and engages the actuator 129 to remain connected to it as the actuator is pressed inwardly forward the compartment separator 147 to dispense fluent material and is then allowed to be returned to the position shown in the drawing to re-expand the secondary compartment 123 to its normal volume.

While the invention has been described in terms of specific embodiments, it will be obvious to those skilled in the art that modifications may be made therein with the scope of the following claims.

What is claimed is:

1. A dispenser for fluent material, said dispenser comprising:

a collapsible container having a flexible wall impervious to air and enclosing a primary compartment to hold the fluent material, the wall having an opening therethrough;

a vented outer case enclosing the collapsible container within a space open to the surrounding environment;

a compartment separator in sealing contact with the perimeter of the opening and mechanically connected to the vented case;

a cover of fluid-tight material extending over at least a part of the compartment separator means and the perimeter of said cover sealed fluid-tight thereto and defining therewith a secondary compartment between the cover and the compartment separator, including a disk which is movable inwardly toward the secondary compartment and outwardly away from the secondary compartment;

resilient means biasing the movable part of the cover away from the compartment separator;

a passage through the compartment separator to allow the fluent material to pass therethrough from the primary compartment to the secondary compartment;

a nozzle communicating with the secondary compartment to allow the fluent material to emerge from the secondary compartment through the nozzle in response to inward movement of the movable part;

valve means mounted on said disk responsive to inward movement of the cover to close the passage to prevent the fluent material from passing from the secondary compartment back into the primary compartment in response to inward movement of the movable part, comprising a piston aligned with the passage to seal the passage when the movable part of the cover is pressed toward the compartment separator, the normal position of the movable part of the cover holding the piston resiliently spaced from the compartment separator means;

a channel for the fluent material through the piston, the movable part of the cover encircling the piston at a region of the piston remote from the compartment separator, the channel having an entrance to the secondary compartment adjacent the part of the piston encircled by the movable part of the cover, whereby a substantial part of the piston can enter and seal the passage through the compartment separator without blocking the entrance to the channel; and an actuator comprising a hollow tube connected to the nozzle to allow the fluent material to pass through the hollow tube to the nozzle, said hollow tube extending through said disk to communicate with the secondary compartment and being rotatably coupled to said disk to rotate with respect thereto, said hollow tube comprising an aperture alignable with the channel to open and close the channel selectively according to the rotational position of the hollow tube with respect to the disk.

2. The invention as defined in claim 1 in which the outer case comprises an elongated tube, the compartment separator is rigid and comprises an annular channel gripping one end of the tube, and the collapsible container is a generally tubular member closed at one end and having the other end captured fluid-tight between the compartment separator means and the tube.

3. The invention as defined in claim 1 in which the surface of the compartment separator facing the movable part of the cover is beveled adjacent the passage to allow communication between the secondary compartment and the entrance to the channel when the movable part of the cover is depressed toward the compartment separator means.

4. The invention as defined in claim 1 in which the means joining the perimeter of the disk fluid-tight to the compartment separator comprises a resilient accordion-pleated skirt.

* * * * *